US006914496B2

(12) United States Patent
Tanaka

(10) Patent No.: US 6,914,496 B2
(45) Date of Patent: Jul. 5, 2005

(54) CENTER-ELECTRODE ASSEMBLY AND MANUFACTURING METHOD THEREFOR, NONRECIPROCAL CIRCUIT DEVICE AND COMMUNICATION APPARATUS USING THE SAME

(75) Inventor: Yasuhiro Tanaka, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/931,685

(22) Filed: Aug. 16, 2001

(65) Prior Publication Data

US 2002/0079981 A1 Jun. 27, 2002

(30) Foreign Application Priority Data

Aug. 25, 2000 (JP) ..... 2000-256434

(51) Int. Cl.[7] ..... H01P 1/36
(52) U.S. Cl. ..... 333/24.2; 333/1.1
(58) Field of Search ..... 333/1.1, 24.2

(56) References Cited

U.S. PATENT DOCUMENTS 4,821,007 A * 4/1989 Fields et al. ..... 333/238
5,498,999 A * 3/1996 Marusawa et al. ..... 333/1.1
5,644,107 A * 7/1997 Kubota et al. ..... 174/262
6,121,851 A * 9/2000 Takane et al. ..... 333/1.1
6,222,425 B1 4/2001 Okada et al. ..... 333/1.1
2002/0089388 A1 * 7/2002 Lingel et al. ..... 333/1.1

FOREIGN PATENT DOCUMENTS

| | | | |
|---|---|---|---|
| CN | 1235410 | 11/1999 | |
| JP | 5-037206 | 2/1993 | |
| JP | 9-186458 | 7/1997 | |
| JP | 09294006 A * | 11/1997 | ..... H01P/1/36 |
| JP | 10-270912 | 10/1998 | |
| JP | 11-097909 | 4/1999 | |

* cited by examiner

*Primary Examiner*—Stephen E. Jones
(74) *Attorney, Agent, or Firm*—Keating & Bennett, LLP

(57) ABSTRACT

There are provided a center-electrode assembly and a manufacturing method therefor, in which electrical characteristics are stable and handling is easy, and which is suitable for mass-production, and a nonreciprocal circuit device and a communication apparatus using the center-electrode assembly. A center-electrode assembly for an isolator includes a ferrite, center-electrode patterns and insulating films deposited on the top surface of the ferrite, a ground pattern formed on the back surface of the ferrite, and connecting electrodes formed on side-faces of the ferrite. Each connecting electrode electrically connects between the center-electrode patterns formed on the top surface and the ground pattern formed on the back surface.

15 Claims, 10 Drawing Sheets

CENTER-ELECTRODE ASSEMBLY AND MANUFACTURING METHOD THEREFOR, NONRECIPROCAL CIRCUIT DEVICE AND COMMUNICATION APPARATUS USING THE SAME

BACKGROUND OF THE INVENTION

1. Field of the Invention

The present invention relates to a center-electrode assembly and a manufacturing method therefor, a nonreciprocal circuit device and a communication apparatus using the center-electrode assembly.

2. Description of the Related Art

A concentrated-constant-type isolator adapted for use in mobile radio communication apparatuses such as portable telephones generally has the capability of allowing a signal to pass-through in a transmission direction and of obstructing the transmission in the reverse direction.

As such a concentrated-constant-type isolator, an isolator having a structure shown in FIG. 14 is known. The concentrated-constant-type isolator 200 comprises a metallic upper case 250 made from a magnetic metal, a permanent magnet 260, a center-electrode assembly 240, a terminal case 230, a metallic lower case 220 made from a magnetic metal, a spacer 280, a resistance element R, and matching-capacitor elements C11, C12, and C13.

The center-electrode assembly 240 is formed by arranging three center-electrodes 271, 272 and 273, which intersect with each other at an angle of approximately 120°, on the top surface of a microwave ferrite 270, with insulating sheets being interposed therebetween. Ports P1, P2 and P3 at respective ends of these center-electrodes 271, 272 and 273 are bent at a right angle. Furthermore, a common shield 276 which is connected in common to the other ends of the respective center-electrodes 271, 272 and 273 is abutted to the bottom surface of the ferrite 270. The common shield 276 substantially covers the entire bottom surface of the ferrite 270.

The conventional center-electrodes 271, 272 and 273 are made by punching a thin metallic plate. As mentioned above, with the common shield 276 of the plate-like center-electrodes 271, 272 and 273 abutted against the bottom surface of the ferrite 270, the ferrite 270 is wrapped by the center-electrodes 271, 272 and 273, and the three center-electrodes 271, 272 and 273 are bent at right angles at the edges of the ferrite 270. In this connection, there has been a problem that the bending position and the bending angle are unstable according to the shape of the ferrite 270 and the bending conditions (the manner of holding and applying force) when the center-electrodes 271, 272 and 273 are bent.

As a result, the mutual-intersecting angle of the center-electrodes is not stable, which may result in the center-electrodes 240 in different units having different electrical characteristics. In particular, as the shape of the center-electrodes becomes complicated and the center-electrode assembly 240 is miniaturized, the above-mentioned tendency becomes conspicuous. Also, another problems is that the operation of wrapping the ferrite 270 with the plate-like center-electrodes is troublesome and the mass-productivity is low.

SUMMARY OF THE INVENTION

Accordingly, the present invention provides a center-electrode assembly and a manufacturing method therefor, in which electrical characteristics are stable and handling is easy, and which is suitable for mass production. The invention further provides a nonreciprocal circuit device and a communication apparatus using the center-electrode assembly.

A center-electrode assembly according to the present invention comprises a ferrite, center-electrode patterns and insulating films deposited on the top surface of the ferrite, a conductive pattern formed on the bottom surface of the ferrite, and connecting electrodes formed on margins of the ferrite for electrically connecting between the center-electrode patterns deposited on the top surface and the conductive pattern formed on the bottom surface.

By this structure, because the center-electrode patterns formed on the top surface of the ferrite and the conductive pattern formed on the back surface of the ferrite are electrically connected together via the connecting electrodes formed on the margins of the ferrite, the ferrite does not need to be wrapped with plate-like center-electrodes. Then, the forming of the center-electrode patterns can be carried out independently of the forming of the connecting electrodes. Thereby, accuracy of arrangement positions of the center-electrode patterns is increased so that the mutual intersecting angles of the center-electrode patterns can be kept constant.

A nonreciprocal circuit device and a communication apparatus according to the present invention comprise a center-electrode assembly having features described above so that excellent electrical characteristics are obtained.

A method for manufacturing a center-electrode assembly according to the present invention comprises the steps of a hole-forming step of forming through-holes on a ferrite mother board, a pattern-forming step of alternately depositing a center-electrode pattern and an insulating film on the top surface of the ferrite mother board while forming a conductive pattern on the back surface, and a cutting step of cutting a center-electrode assembly from the ferrite mother board by cutting the ferrite mother board at intervals of a predetermined size, whereby the center-electrode patterns formed on the top surface and the conductive pattern formed on the back surface are electrically connected via connecting electrodes formed in the through-holes in the center-electrode assembly.

This method of manufacturing a center-electrode assembly is excellent for mass production.

Other features and advantages of the present invention will become apparent from the following description of the invention which refers to the accompanying drawings.

DESCRIPTION OF EMBODIMENTS OF THE INVENTION

Embodiments of a center-electrode assembly, a manufacturing method therefor, and a nonreciprocal circuit device and a communication apparatus using the center-electrode assembly according to the present invention will be described below with reference to the attached drawings.

[First Embodiment, FIGS. 1 to 6]

Figure 1:
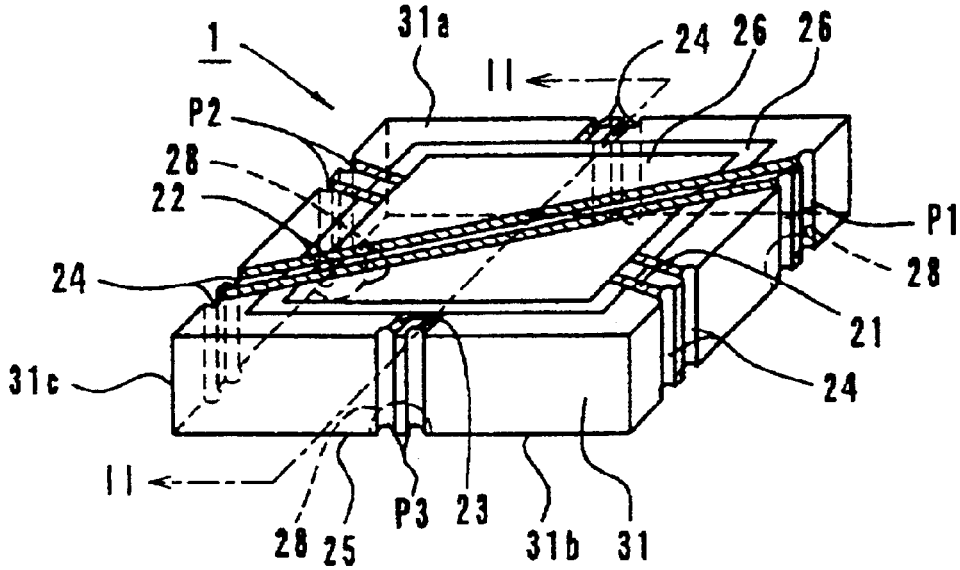
FIG. 1 is an exterior perspective view of a center-electrode assembly according to an embodiment of the present invention.
Figure 2:
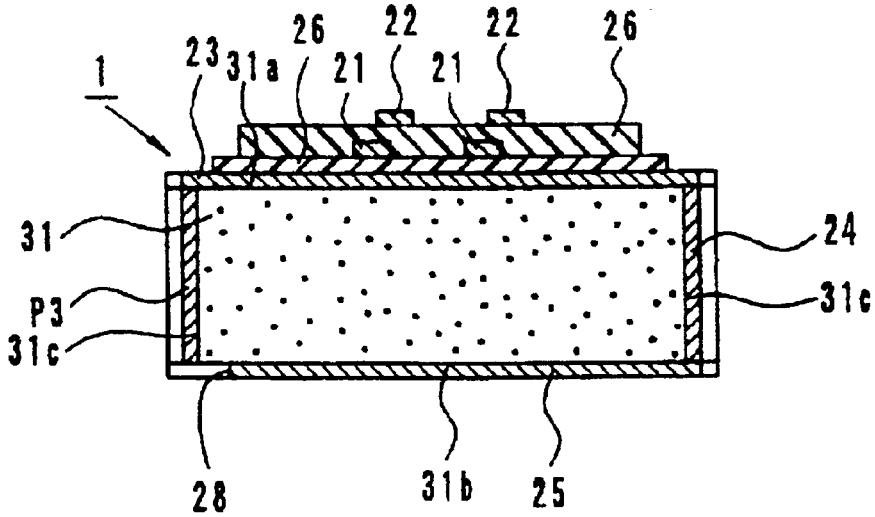
FIG. 2 is a longitudinal sectional view of FIG. 1.

FIG. 1 is an external perspective view of an embodiment of a center-electrode assembly 1 according to the present invention, and FIG. 2 is a longitudinal sectional view of FIG. 1. A center-electrode assembly 1 comprises a block-like microwave ferrite 31, center-electrode patterns 21, 22 and 23, connecting electrodes 24, a ground pattern 25.

On the top surface (one magnetic-pole surface) 31*a* of the ferrite 31, three pairs of center-electrode patterns 21, 22 and 23 are arranged and intersect with each other at an angle of approximately 120° with an insulating film 26 interposed therebetween. Each pair of center-electrode patterns 21, 22, and 23 are arranged in parallel with each other. One end of each pair of center-electrode patterns 21, 22 and 23 is electrically connected to connecting electrodes 24 formed on the side-face 31*c* of the ferrite 31, respectively. The other end of each pair of center-electrode patterns 21, 22 and 23 is electrically connected to respective ports P1, P2 and P3 formed on the side-face 31*c* of the ferrite 31. The ports P1 to P3 are for electrically connecting the center-electrode assembly 1 to external circuits.

On the substantially entire back surface 31*b* of the ferrite 31, the ground pattern 25 is formed. The ground pattern 25 is electrically connected to the connecting electrodes 24 formed on the side-face 31*c* of the ferrite 31. Therefore, the center-electrode patterns 21, 22 and 23 formed on the top surface 31*a* of the ferrite 31 are electrically connected to the ground pattern 25 formed on the back surface 31*b* via the connecting electrodes 24, respectively. A gap 28 is also formed between the ground pattern 25 and each of the ports P1 to P3 formed on the side-face 31*c* of the ferrite 31, so that the ground pattern 25 is separated from the ports P1 to P3.

The center-electrode patterns 21, 22 and 23 and the ground pattern 25 are made from a conductive material such as Ag, Cu, Au, Al, and Be, and are formed by a method such as printing and sputtering. The insulating film 26 is made from glass, ceramic, a resin, and so forth, and is formed by a method such as printing. On the other hand, the connecting electrodes 24 and the ports P1 to P3 are also made from a conductive material such as Ag, Cu, Au, Al, and Be, and are formed by a method such as plating, printing, and sputtering. These patterns 21, 22 and 23, and 25, the connecting electrodes 24, and the ports P1 to P3 can be formed independently of each other.

That is, because in the center-electrode assembly 1, the center-electrode patterns 21, 22 and 23 formed on the top surface 31*a* of the ferrite 31 are electrically connected to the ground pattern 25 formed on the back surface 31*b* via the connecting electrodes 24 formed on the side-face 31*c* of the ferrite 31, the ferrite does not need to be wrapped with plate-like center-electrodes. The center-electrode patterns 21, 22 and 23 can be formed independently of the forming of the connecting electrodes 24. Thereby, accuracy in arrangement positions of the center-electrode patterns 21, 22 and 23 is increased so that the mutual intersecting angle of the center-electrode patterns 21, 22 and 23 can be kept constant. As a result, the center-electrode assembly 1 having stable electrical characteristics can be obtained.

Figure 3:
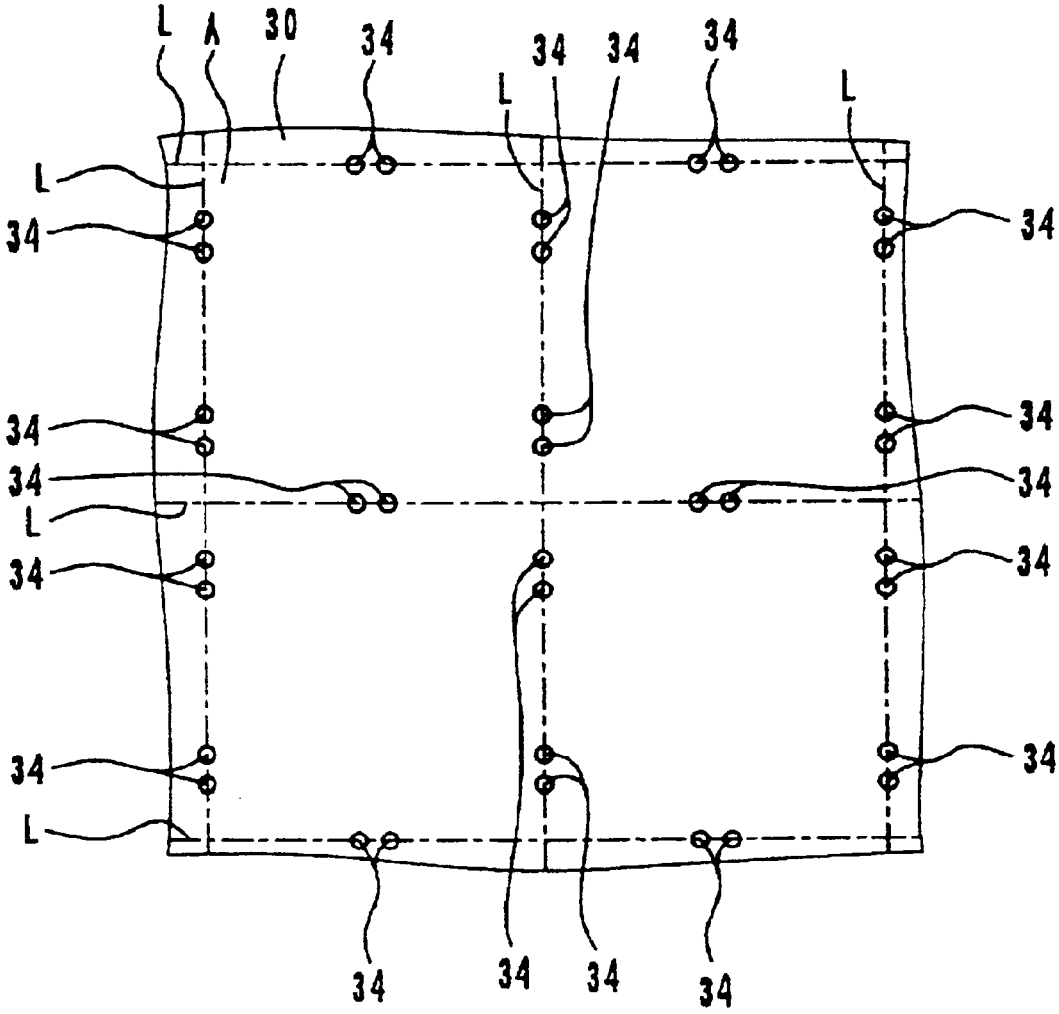
FIG. 3 is a plan view showing an embodiment of a manufacturing method of the center-electrode assembly shown in FIG. 1.

Next, a manufacturing method of the center-electrode assembly 1 will be described. As shown in FIG. 3, at predetermined positions on a ferrite mother-board 30, top-to-bottom piercing-holes are formed by a laser process, a grinding process, or the like. By filling the inside of the top-to-bottom piercing-hole with conductive paste, or by forming a plated film on the internal wall of the top-to-bottom piercing-hole, a through-hole 34 is formed (a hole-forming step). In addition, dash-dot line L and range A surrounded by the dash-dot line L show the cutting position and the size of a product, which will be described later, respectively.

Figure 4:
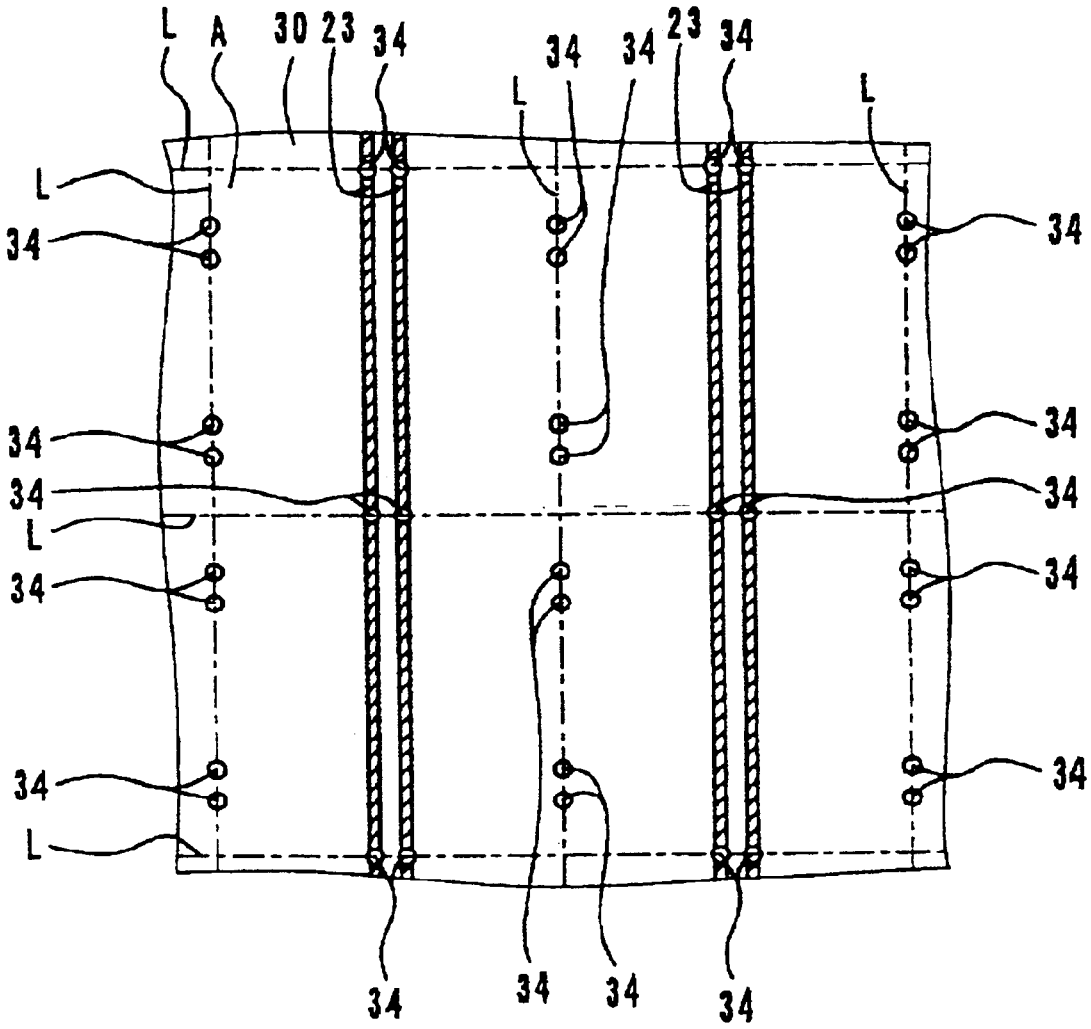
FIG. 4 is a plan view showing a manufacturing process continued from FIG. 3.

Next, as shown in FIG. 4, a pair of center-electrode patterns 23 are formed on the top surface 31*a* of the ferrite mother-board 30 by a method such as printing, sputtering, vapor deposition, applying paste, or plating (a pattern-forming step). The pair of center-electrode patterns 23 are formed so as to electrically connect between the through-holes 34 opposing each other.

Figure 5:
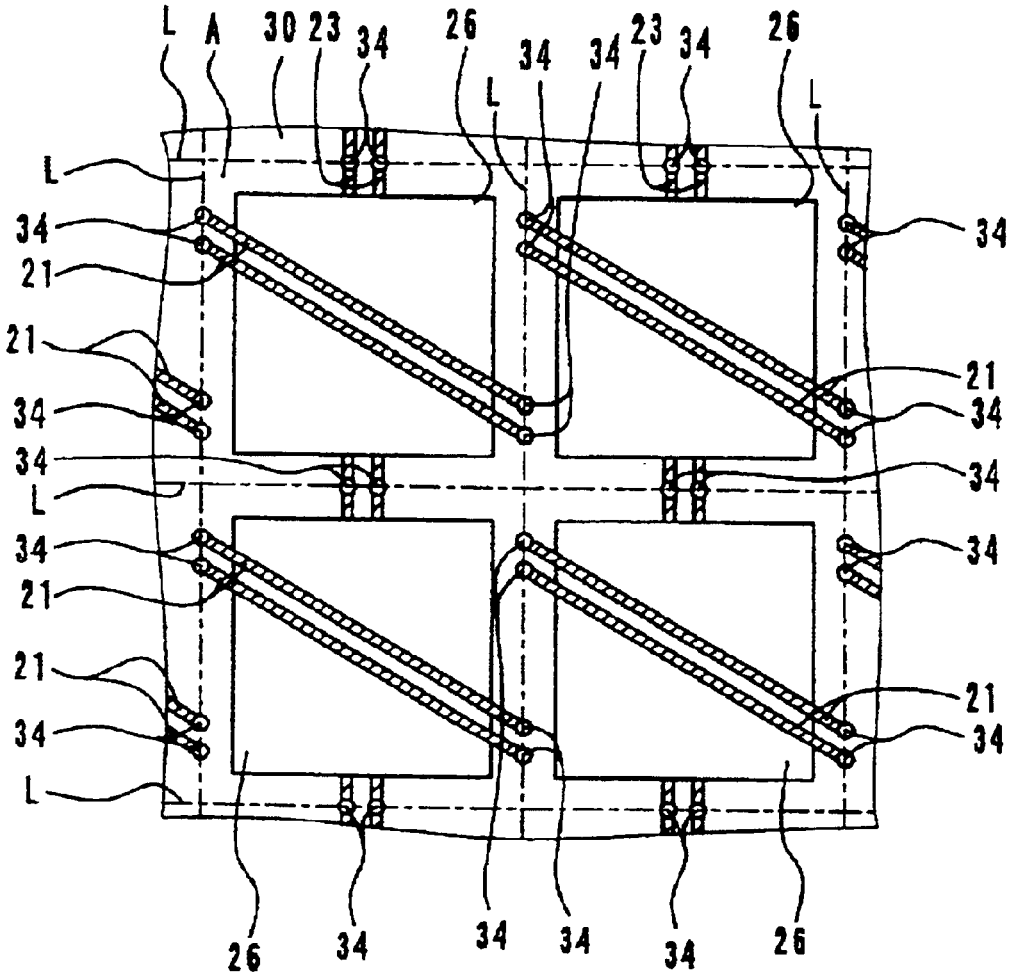
FIG. 5 is a plan view showing a manufacturing process continued from FIG. 4.

Furthermore, as shown in FIG. 5, the insulating films 26 are formed on the top surface 31*a* of the ferrite mother-board 30 leaving exposed the regions on which the through-holes 34 are formed. The insulating film 26 may be formed by printing and firing insulating paste, or it may be formed by a method such as sputtering, vacuum evaporation, or chemical-vapor deposition (CVD). A pair of center-electrode patterns 21 are further formed thereon so as to electrically connect between the through-holes 34 diagonally opposing each other.

Figure 6:
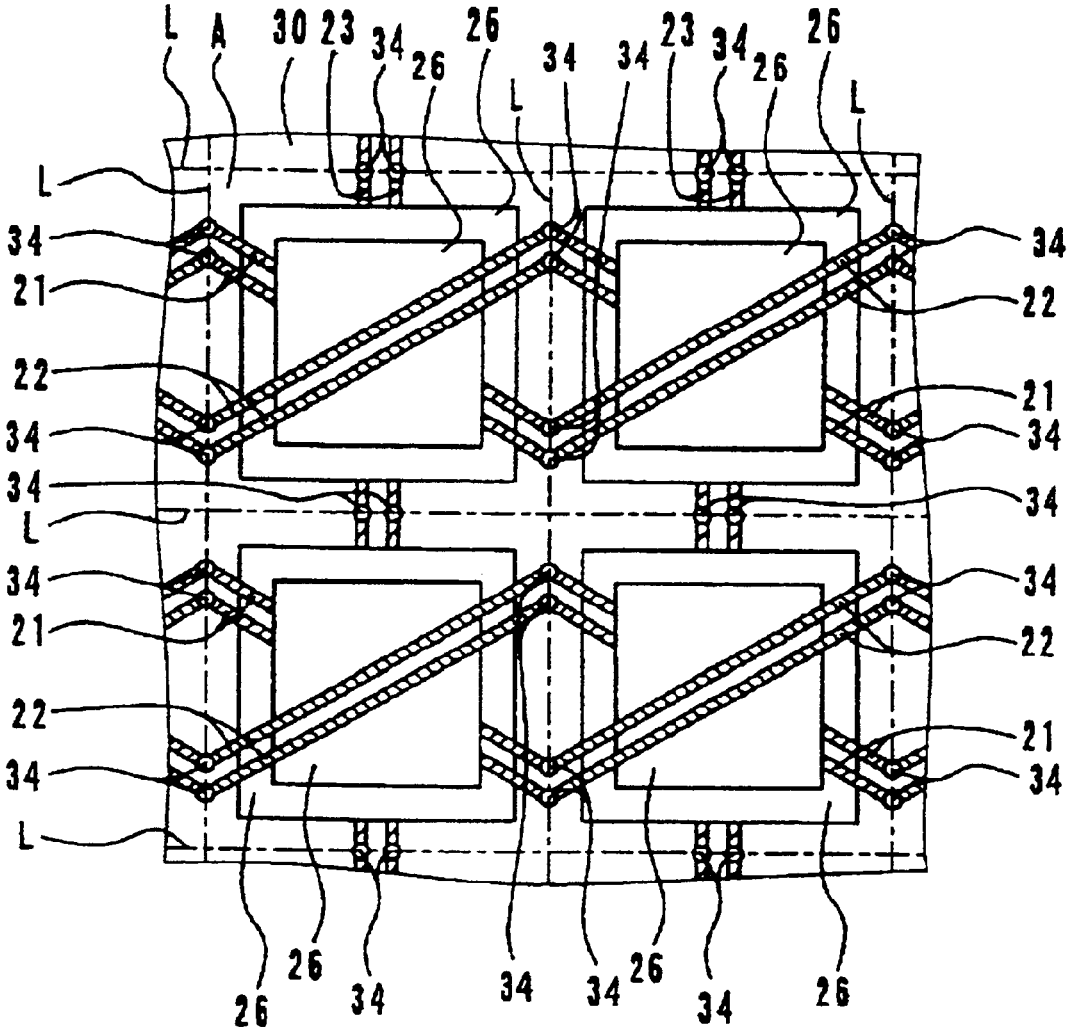
FIG. 6 is a plan view showing a manufacturing process continued from FIG. 5.

Similarly, as shown in FIG. 6, the insulating films 26 are further formed thereon leaving exposed the regions on which the through-holes 34 are formed. A pair of center-electrode patterns 22 are further formed thereon so as to electrically connect between the through-holes 34 diagonally opposing each other. In such a manner, on the top surface of the ferrite mother-board 30, the center-electrode patterns 21, 22 and 23 and the insulating films are alternately deposited. Then, on the back surface of the ferrite mother-board 30, the ground pattern 25 is formed.

Then, at positions indicated by dash-dot line L, i.e., at the positions of the through-holes 34, the ferrite mother-board 30 is cut at intervals corresponding to the size of each product (a cutting step). The cutting is carried out by using laser, dicing, or the like. The through-hole 34 is divided into two so that the connecting electrodes 24 and the ports P1 to P3 shown in FIG. 1 are formed. In such a manner, an excellent manufacturing method of the center-electrode assembly 1 for mass production can be obtained.

Figure 7:
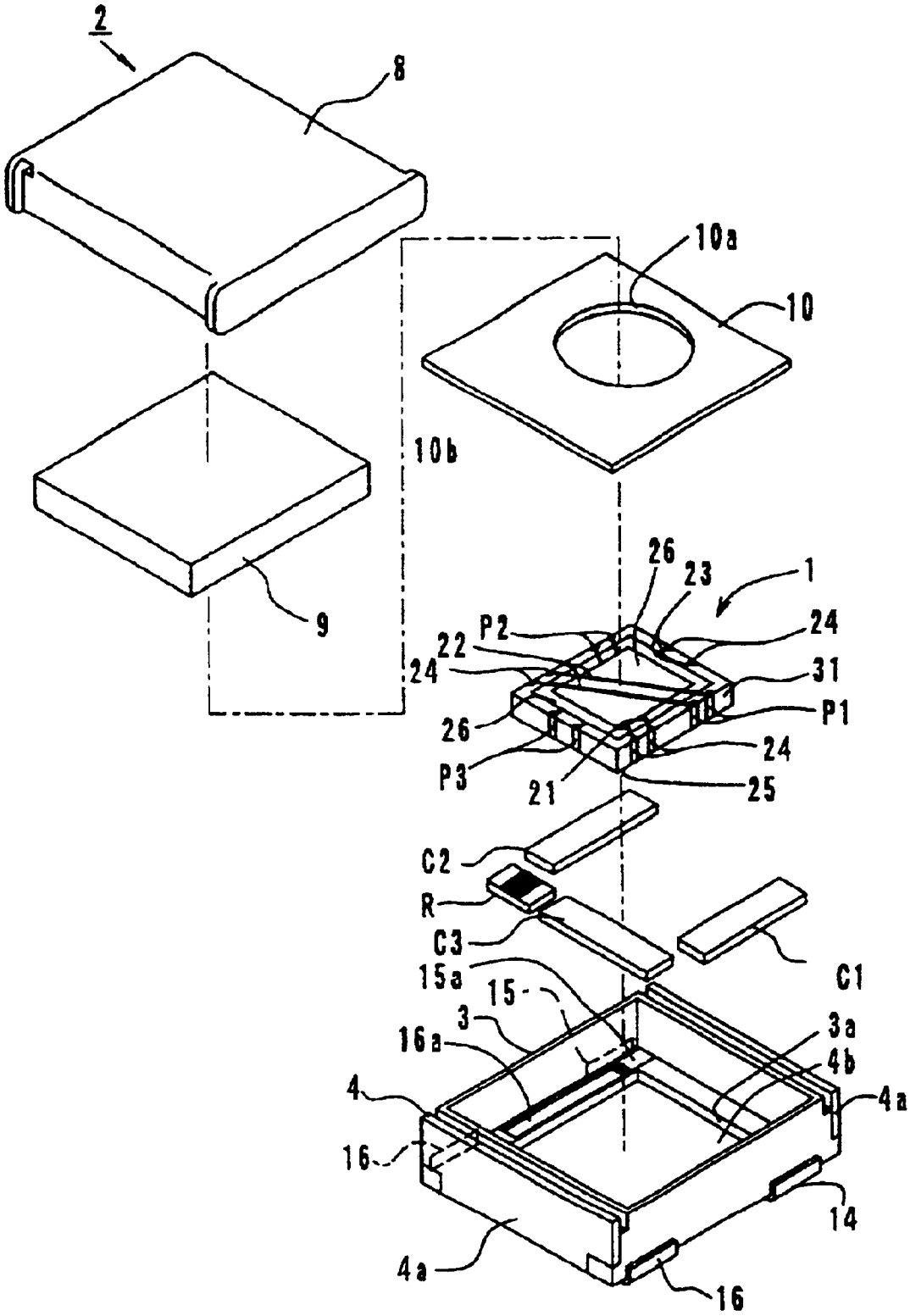
FIG. 7 is an assembly view showing the structure of a nonreciprocal circuit device according to an embodiment of the present invention.
Figure 8:
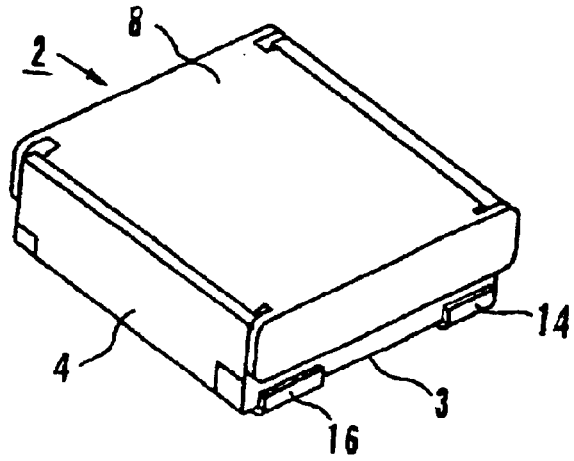
FIG. 8 is an exterior perspective view of the nonreciprocal circuit device shown in FIG. 7 after completion of assembling.
Figure 9:
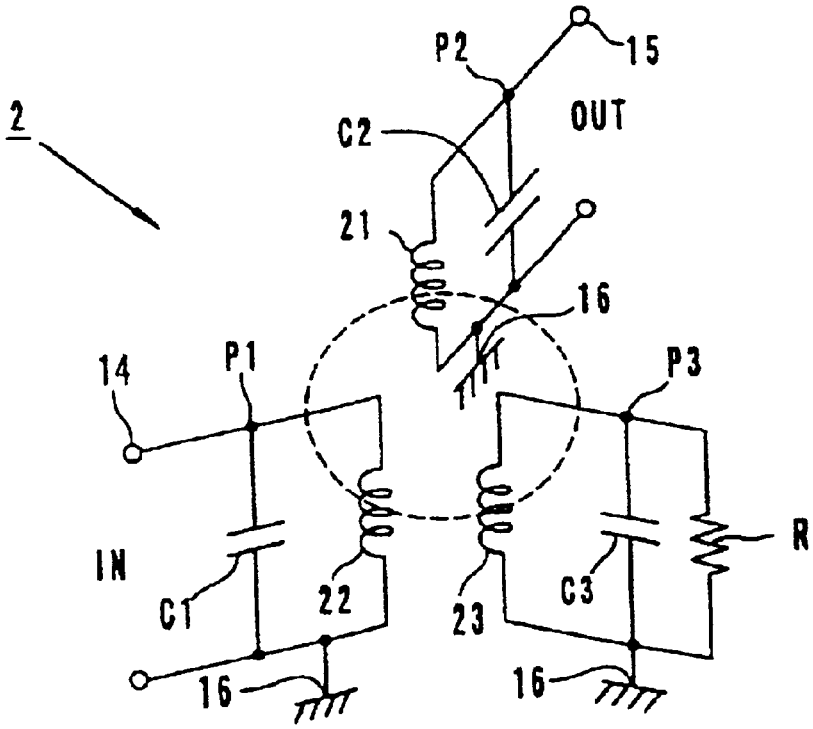
FIG. 9 is an electrical equivalent-circuit diagram of the nonreciprocal circuit device shown in FIG. 7.

[Second Embodiment, FIGS. 7 to 9]

FIG. 7 is an assembly view of an embodiment of a nonreciprocal circuit device according to the present invention and FIG. 8 is an external perspective view of the nonreciprocal circuit device 2 shown in FIG. 7 after completion of the assembling. The nonreciprocal circuit device 2 is a concentrated-constant-type isolator.

As is shown in FIG. 7, the concentrated-constant-type isolator 2 comprises a metallic lower case 4, a resin terminal case 3, the center-electrode assembly 1 shown in the first embodiment, a metallic upper case 8, a permanent magnet 9, an insulating spacer 10, a resistance element R, and matching-capacitor elements C1, C2 and C3.

In the center-electrode assembly 1, the ground pattern 25 formed on the bottom surface 31*b* of the ferrite 31 is connected to the bottom wall 4*b* of the metallic lower case 4 by a method such as soldering via a window portion 3*a* of the resin terminal case 3 so as to be grounded.

In the resin terminal case 3, input-output terminals 14 and 15 and ground terminals 16 are insert-molded. One end of the output terminal 15 is exposed on an external wall of the resin terminal case 3 and the other end is exposed on an internal face of the resin terminal case 3 so as to form an input-output draw-out electrode 15*a*. One end of the input terminal 14 is exposed on an external wall of the resin terminal case 3 and the other end is exposed on an internal face of the resin terminal case 3 so as to form an input-output draw-out electrode (not shown). Similarly, one end of each of the two ground terminals 16 is exposed on the respective opposing external walls of the resin terminal case 3 and the other end is exposed on an internal face of the resin terminal case 3 so as to form ground draw-out electrodes 16*a*.

In the matching-capacitor elements C1, C2 and C3, hot-side capacitor electrodes are electrically connected to the ports P1, P2 and P3, respectively, by a method such as solder reflow or wire bonding, while cold-side capacitor electrodes are electrically connected to the ground draw-out electrodes 16*a* of the ground terminals 16, which are exposed on an internal face of the resin terminal case 3, respectively.

In the resistance element R, at both ends of an insulating substrate, terminal electrodes are formed by thick-film printing, and between the terminal electrodes is arranged a resistor of a thick film made from cermet, carbon, or ruthenium, or made from a metallic thin film. For a material of the insulating substrate, dielectric ceramic such as alumina is used. On the surface of the resistor, a film of glass may be formed.

One terminal electrode of the resistance element R is connected to the hot-side capacitor electrode of the matching-capacitor element C3 and the other terminal electrode is connected to the ground terminal 16. That is, the matching-capacitor element C3 and the resistance element R are electrically connected in parallel between the port P3 of the center-electrode assembly 1 and the ground.

The insulating spacer 10 is arranged on the upper face of the center-electrode assembly 1. The insulating spacer 10 is provided with a hole 10*a* for accommodating the center-electrode patterns 21 and 22 and the insulating films 26 which are sandwiched on top of one another on the central top surface of the ferrite 31. However, the insulating spacer 10 is not necessarily required.

The metallic lower case 4 is provided with right and left side-walls 4*a* and a bottom wall 4*b*. While the resin terminal case 3 is arranged on the metallic lower case 4, within the resin terminal case 3, the center-electrode assembly 1, the matching-capacitor elements C1 to C3, and so forth are accommodated, and the metallic upper case 8 is fitted thereto. On the bottom surface of the metallic upper case 8, the permanent magnet 9 is bonded, thereby to apply a direct-current magnetic field to the center-electrode assembly 1. The metallic lower case 4 and the metallic upper case 8 forming a magnetic circuit and also serving as yokes are made by punching and bending a plate having high permeability such as Fe and silicon steel and thereafter plating the surfaces thereof with Cu or Ag.

In such a manner, the concentrated-constant-type isolator 2 shown in FIG. 8 is obtained. FIG. 9 is an electrical equivalent-circuit diagram of the concentrated-constant-type isolator 2. Because the concentrated-constant-type isolator 2 is provided with the center-electrode assembly 1 having features described above, excellent electrical characteristics can be exhibited.

Figure 10:
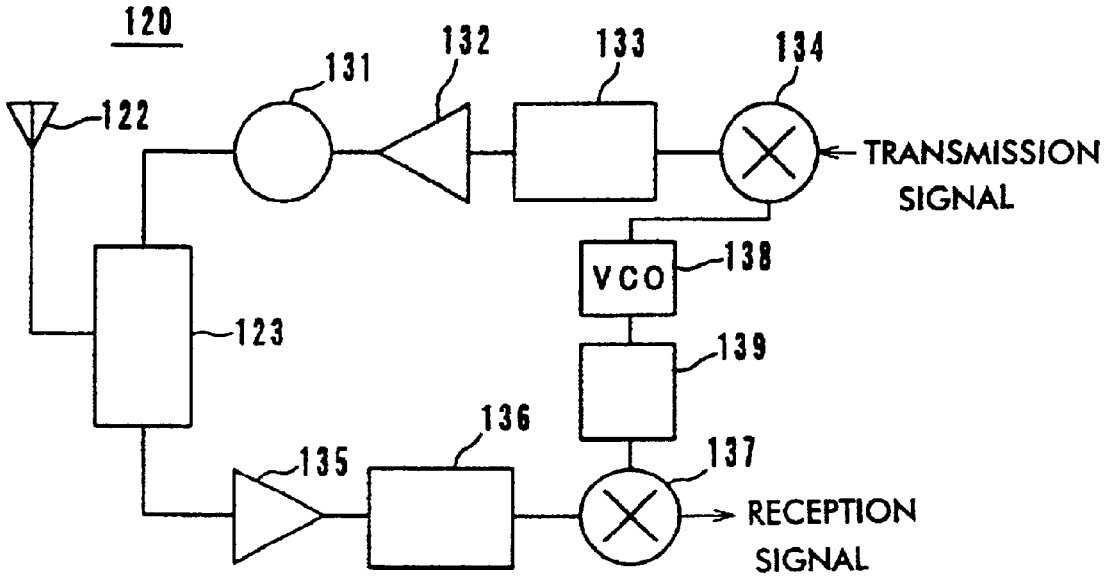
FIG. 10 is a block diagram showing an embodiment of a communication apparatus according to the present invention.

[Third Embodiment, FIG. 10]

A third embodiment will be described by exemplifying a portable telephone as a communication apparatus according to the present invention.

FIG. 10 is an electrical-circuit block diagram of an RF section of a portable telephone 120. In FIG. 10 shown are an antenna element 122, a duplexer 123, an isolator in the transmitting side 131, an amplifier in the transmitting side 132, an interstage band-pass filter in the transmitting side 133, a mixer in the transmitting side 134, an amplifier in the receiving side 135, an interstage band-pass filter in the receiving side 136, a mixer in the receiving side 137, a voltage-controlled oscillator (VCO) 138, and a local band-pass filter 139.

As the isolator in the transmitting side 131, the concentrated-constant-type isolator 2 according to the second embodiment can be used. By mounting the isolator 2 thereon, a portable telephone having excellent electrical characteristics can be achieved.

[Other Embodiments]

The present invention is not limited to the embodiments described above and various modifications can be made within the scope of the present invention.

For example, the shapes and arrangement of the center-electrode patterns 21, 22 and 23 and the ground pattern 25 in the first embodiment are arbitrary. The same center-electrode patterns may also be formed on both faces of the ferrite.

Figure 11:
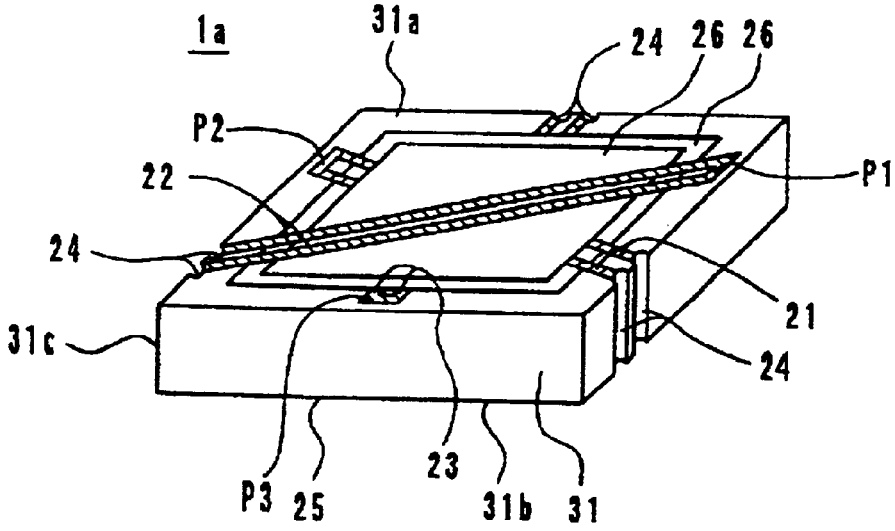
FIG. 11 is an exterior perspective view showing another embodiment of a center-electrode assembly according to the present invention.

As shown in FIG. 11, a center-electrode assembly la may be formed in which the respective ports P1 to P3 of the center-electrode patterns 21, 22 and 23 are bonding pads formed on the top surface 31*a* of the ferrite 31.

Figure 12:
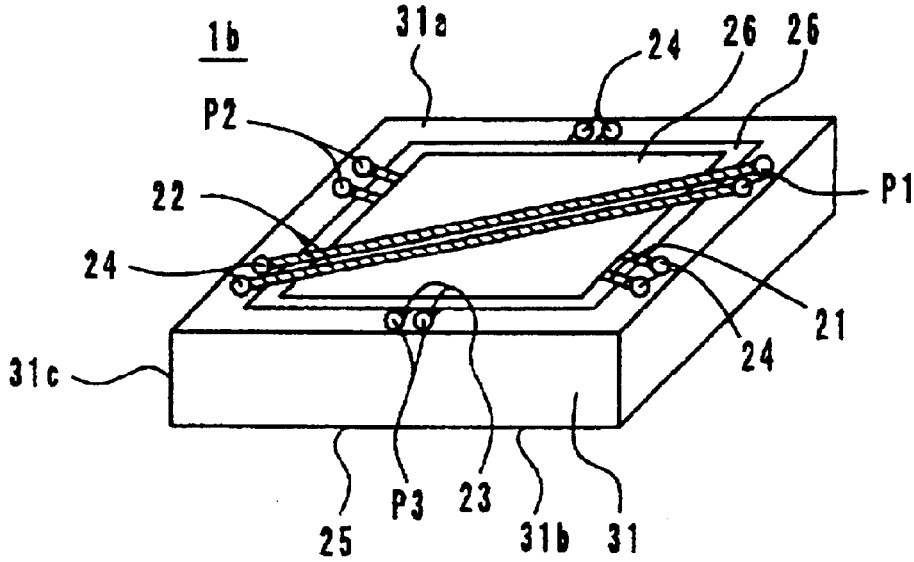
FIG. 12 is an exterior perspective view showing still another embodiment of a center-electrode assembly according to the present invention.

Also, as shown in FIG. 12, a center-electrode assembly 1*b* may be formed, in which the connecting electrodes (through-holes) are not formed on the side faces 31*c* of the ferrite 31 but are formed inside (in external peripheral portions of) the ferrite 31.

Figure 13:
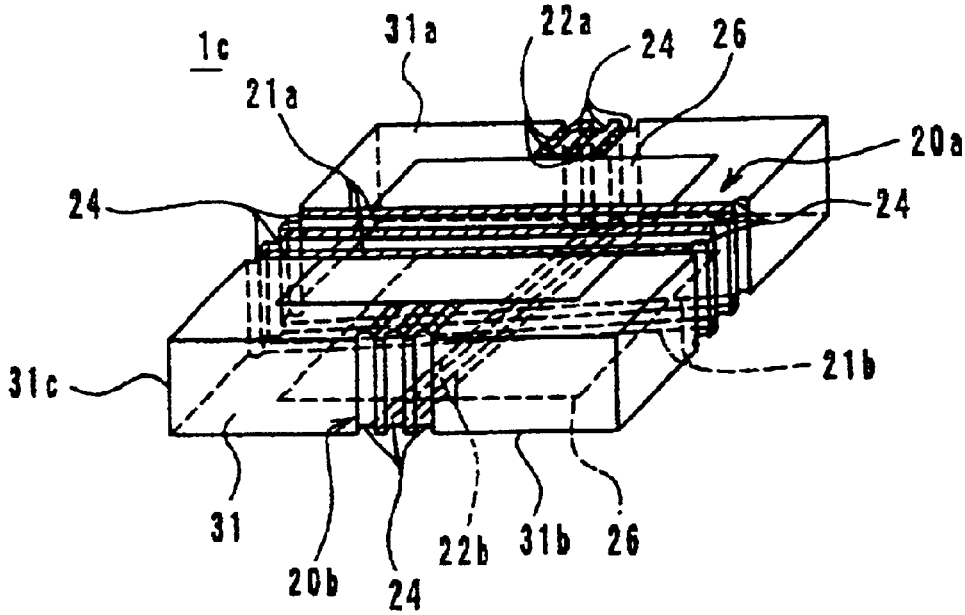
FIG. 13 is an exterior perspective view showing yet another embodiment of a center-electrode assembly according to the present invention.
Figure 14:
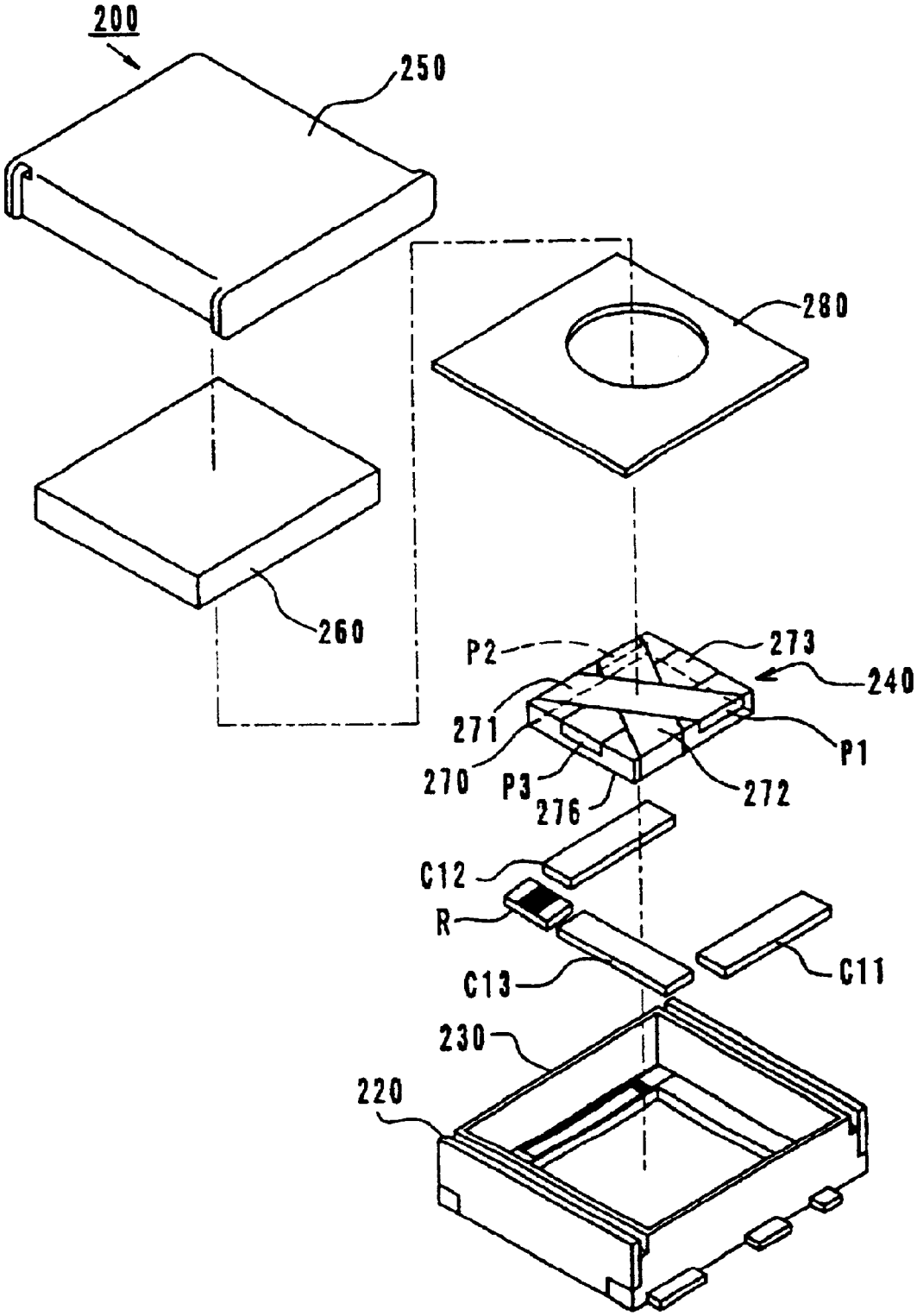
FIG. 14 PRIOR ART
FIG. 14 is an assembly view showing a conventional center-electrode assembly and a nonreciprocal circuit device using the conventional center-electrode assembly.

Furthermore, as shown in FIG. 13, on the top surface 31*a* of the ferrite 31, center-electrode patterns 21*a* and 22*a* are arranged so as to intersect with each other at an angle of approximately 90°, and center-electrode patterns 21*b* and 22*b* are arranged on the back surface 31*b* so as to intersect with each other at an angle of approximately 90°. Then, the center-electrode patterns 21*a* and 21*b* are connected together in series via the connecting electrodes 24 formed on the side-faces 31*c* of the ferrite 31 so as to form coil center-electrodes 20*a* turning about the ferrite 31. Similarly, the center-electrode patterns 22*a* and 22*b* are connected together in series via the connecting electrodes 24 so as to form coil center-electrodes 20*b* turning about the ferrite 31. A center-electrode assembly 1*c* may be formed which has the coil center-electrodes 20*a* and 20*b* intersecting with each other at an angle of approximately 90°, which are obtained in such a manner.

The center-electrode assembly may have such an arbitrary shape as a cylinder, a rectangular shape as well as other multi-angular shapes. The present invention may be applied to various nonreciprocal circuit devices such as a circulator other than the isolator.

The insulating film 26 may have any thickness as long as it can electrically insulate the center-electrode patterns 21, 22 and 23 from each other, and it may be circular-shaped or band-shaped, or it may be formed on the substantially entire top surface 31*a* of the ferrite 31. Moreover, as a forming method of the insulating film 26, instead of using the insulating paste, the center-electrode patterns 21, 22 and 23 may be mutually insulated with oxide films which are formed by oxidation of the surfaces of the center-electrode patterns 21, 22 and 23.

In a manufacturing method of the center-electrode assembly, the hole-forming step may be performed after the pattern-forming step.

Even when substituting any general ferromagnetic material (primary magnet), not limited to ferrite, the same advantages can of course be achieved.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A center-electrode assembly comprising:

a ferrite;

center-electrode patterns and insulating films disposed on the top surface of the ferrite;

a conductive pattern formed on the bottom surface of the ferrite; and connecting electrodes directly formed on sides of the ferrite; wherein the connecting electrodes electrically connect the center-electrode patterns and the conductive pattern;

said connecting electrodes, said center-electrode pattern and said conductive pattern are comprised of at least one of a plated conductive material, a printed conductive material, a sputtered conductive material, a vapor deposited conductive material, and an applied paste conductive material formed directly on the sides, on the top surface and on the bottom surface, respectively, of the ferrite;

the center-electrode patterns and the insulating films are alternately disposed such that each of the center electrode patterns includes a portion that is in direct contact with a respective one of the insulating films and another portion that is in direct contact with the top surface of the ferrite mother board; and the connecting electrodes are formed on grooves formed in the sides of the ferrite.

2. A communication apparatus comprising a center-electrode assembly according to claim 1, and connected thereto, at least one of a transmission circuit and a reception circuit.

3. A center-electrode assembly according to claim 1, further comprising:

ports directly formed on the upper surface of the ferrite; wherein the ports are electrically connected with the connecting electrodes via the center-electrode patterns.

4. A nonreciprocal circuit device comprising:

a permanent magnet;

a center-electrode assembly according to claim 1 to which a direct-current magnetic field is applied by the permanent magnet; and a metallic case accommodating the permanent magnet and the center-electrode assembly.

5. A communication apparatus comprising a nonreciprocal circuit device according to claim 4, and connected thereto, at least one of a transmitting circuit and a reception circuit.

6. A center-electrode assembly according to claim 1, further comprising:

ports directly formed on the sides of the ferrite; wherein the ports are electrically connected with the connecting electrodes via the center-electrode patterns.

7. A center-electrode assembly according to claim 6, further comprising:

gaps formed on the bottom surface of the ferrite; wherein the gaps are provided between ends of the ports and an end of the conductive pattern.

8. A method for manufacturing a center-electrode assembly comprising the steps of:

forming through-holes in a ferrite mother board;

alternately depositing a plurality of center-electrode patterns and a plurality of insulating films on the top surface of the ferrite mother board, the center-electrode patterns are formed by at least one of a plating method, a printing method, a sputtering method, a vapor deposition method, and a conductive paste applying method;

forming a conductive pattern on the back surface of the ferrite mother board by at least one of a plating method, a printing method, a sputtering method, a vapor deposition method, and a conductive paste applying method;

cutting a center-electrode assembly from the ferrite mother board by cutting the ferrite mother board at intervals of a predetermined size; and forming connecting electrodes in the through-holes in the center electrode assembly by at least one of a plating method, a printing method, a sputtering method, a vapor deposition method and a conductive paste applying method to electrically connect the center-electrode patterns formed on the top surface and the conductive pattern formed on the back surface; wherein the plurality of center-electrode patterns and the plurality of insulating films are alternately deposited such that each of the plurality of center electrode patterns includes a portion that is in direct contact with a respective one of the plurality of insulating films and another portion that is in direct contact with the top surface of the ferrite mother board.

9. A method for manufacturing a communication apparatus comprising the steps of:

providing a center-electrode assembly formed by the method according to claim 8; and connecting at least one of a transmission circuit and a reception circuit to the center-electrode assembly.

10. The method for manufacturing a center-electrode assembly according to claim 8, wherein the connecting electrodes are formed on grooves formed in the sides of the ferrite.

11. The method for manufacturing a center-electrode assembly according to claim 8, further comprising the step of:

forming ports directly on the upper surface of the ferrite; wherein the ports are electrically connected with the connecting electrodes via the plurality of center-electrode patterns.

12. A method for manufacturing a nonreciprocal circuit device comprising the steps of:

providing a permanent magnet;

providing a center-electrode assembly formed by the method according to claim 8 to which a direct-current magnetic field is applied by the permanent magnet; and providing a metallic case accommodating the permanent magnet and the center-electrode assembly.

13. A method for manufacturing a communication apparatus comprising the steps of:

providing a nonreciprocal circuit device formed by the method according to claim 12; and connecting at least one of a transmitting circuit and a reception circuit to the nonreciprocal circuit device.

14. The method for manufacturing a center-electrode assembly according to claim 8, further comprising the step of:

forming ports directly on the sides of the ferrite; wherein the ports are electrically connected with the connecting electrodes via the plurality of center-electrode patterns.

15. The method for manufacturing a center-electrode assembly according to claim 14, further comprising the step of:

forming gaps on the bottom surface of the ferrite; wherein the gaps are provided between ends of the ports and an end of the conductive pattern.

* * * * *